United States Patent [19]

Vrana

[11] 4,077,166

[45] Mar. 7, 1978

[54] APPARATUS FOR CONTINUOUSLY CONVEYING AND SIMULTANEOUSLY TURNING OBJECTS OF ARBITRARY SHAPE AND SIZE

[75] Inventor: Miroslav Vrana, Zurich, Switzerland

[73] Assignee: Hans A. Dietiker, Zollikerberg, Switzerland

[21] Appl. No.: 767,595

[22] Filed: Feb. 10, 1977

[30] Foreign Application Priority Data

Mar. 4, 1976 Switzerland ..... 2727/76

[51] Int. Cl.[2] ..... B24C 3/14; B24C 3/24

[52] U.S. Cl. ..... 51/420; 198/786

[58] Field of Search ..... 15/3.13, 3.14, 3.18, 15/3.2, 306 B; 51/419, 420; 134/134; 198/786

[56] References Cited

U.S. PATENT DOCUMENTS

| | | | |
|---|---|---|---|
| 2,204,636 | 6/1940 | Turnbull | 51/419 |
| 3,383,803 | 5/1968 | Schulte | 51/420 |
| 3,604,158 | 9/1971 | Daffron | 51/420 |
| 3,728,822 | 4/1973 | Noble | 51/419 |
| 3,748,787 | 7/1973 | Carpenter | 51/420 |

*Primary Examiner*—Gary L. Smith

*Attorney, Agent, or Firm*—Benoit Law Corporation

[57] ABSTRACT

Apparatus for continuously conveying and simultaneously turning objects of arbitrary shape and size include a rotating roller and segments extending longitudinally on the periphery of the roller and being periodically subjected to reciprocating axial displacement. An object conveyor and turning trough has at least a bottom portion formed by the segmented roller.

9 Claims, 2 Drawing Figures

APPARATUS FOR CONTINUOUSLY CONVEYING AND SIMULTANEOUSLY TURNING OBJECTS OF ARBITRARY SHAPE AND SIZE

BACKGROUND OF THE INVENTION

1. Field of the Invention

The invention is related to apparatus for continuously conveying and simultaneously turning objects of arbitrary shape and size and, more specifically, to apparatus of this type with an object conveying and turning trough of which at least a bottom portion is formed by a rotating roller.

2. Prior Art

Workpieces or parts, the surface of which is to be uniformly treated on all sides, such as for the purpose of cleaning or coating, or for surface finishing with abrasive material jets, have to be fed to the processing operation in such a manner that they are continuously moved onward in the processing zone and are simultaneously revolved or turned according to their shape.

From Swiss Patent 535,693 an apparatus of the initially mentioned type has become known for a jet treatment of objects, wherein the objects through their own weight depress resilient bristles or lamina disposed on rollers and, during rotation of the rollers, are propelled through succeeding bristles or lamina which are tilted in the direction of propulsion. The linear propulsion of the workpieces thus depends on the relationship of the weight of the workpiece to the elasticity of the bristles or lamina. Relatively light bodies or objects do not depress the bristles or lamina, while relatively heavy bodies cannot be moved on by the succeeding bristles or lamina. Bodies or objects of an unfavorable or irregular shape are unsuitable for transport in such prior-art apparatus. Also, small, light workpieces with holes or eyelets tend to get caught up in the bristles. Finally, the wear of the bristles or lamina due to heating and abrasion is relatively high because of the necessity to make the bristles or lamina of an elastic material. Moreover, the employment of such apparatus in jet-type machines, where jets of hard, abrasive materials are used, is inappropriate, since these jets would destroy the bristles or lamina in a short time.

Another known apparatus employs two rollers arranged side-by-side rotating in the same sense. Arranged below these rollers is a chain which by means of cams reaches between the rollers into the conveyor track and takes care of the advance of the workpieces rotating between the two rollers. It is evident that this apparatus can only be utilized for relatively rugged workpieces of substantially cylindrical shape.

SUMMARY OF THE INVENTION

It is an object of this invention to provide an apparatus of the above mentioned type in such a manner that it can withstand destruction by abrasion, heat or chemical effects and that the transport speed of the objects is adaptable to the need at hand.

According to the subject invention, this object is met by providing a roller with segments extending longitudinally on the periphery of, and being mounted for limited axial displacement on, the roller, and means for periodically imparting to the segments a reciprocating axial displacement.

To provide for the requisite displacement, the apparatus in accordance with a preferred embodiment includes a relatively stationary cam block and associated cam follower means connected to the segments on the roller. Preferably, a cam follower roller or pin may be connected to the segments and engage a cam track in a relatively stationary cam block.

In accordance with a further preferred embodiment of the invention, a lateral wall portion of an object conveying and turning trough is formed by a second roller which rotates in the same sense as the first roller.

In accordance with a further preferred embodiment of the invention, it would also be possible to form both lateral wall portions of the trough by a second and third roller, respectively, of which at least one is driven in the same sense of rotation as the primary roller with the segments.

In accordance with a particularly preferred embodiment of the invention, the cam block with cam track is releasably arranged on frame structure of the apparatus and is angularly adjustable about an axis of rotation of the first-mentioned roller. This arrangement renders it possible to adjust the cam block with cam track in such a manner that there is imparted to the segments within the useful region, i.e. the region which provides the bottom portion of the trough, a predetermined travel which determines the speed of conveyance of the objects.

BRIEF DESCRIPTION OF THE DRAWINGS

A preferred embodiment of the invention is shown by way of example in the drawing, in which.

DESCRIPTION OF PREFERRED EMBODIMENTS

Figure 1:
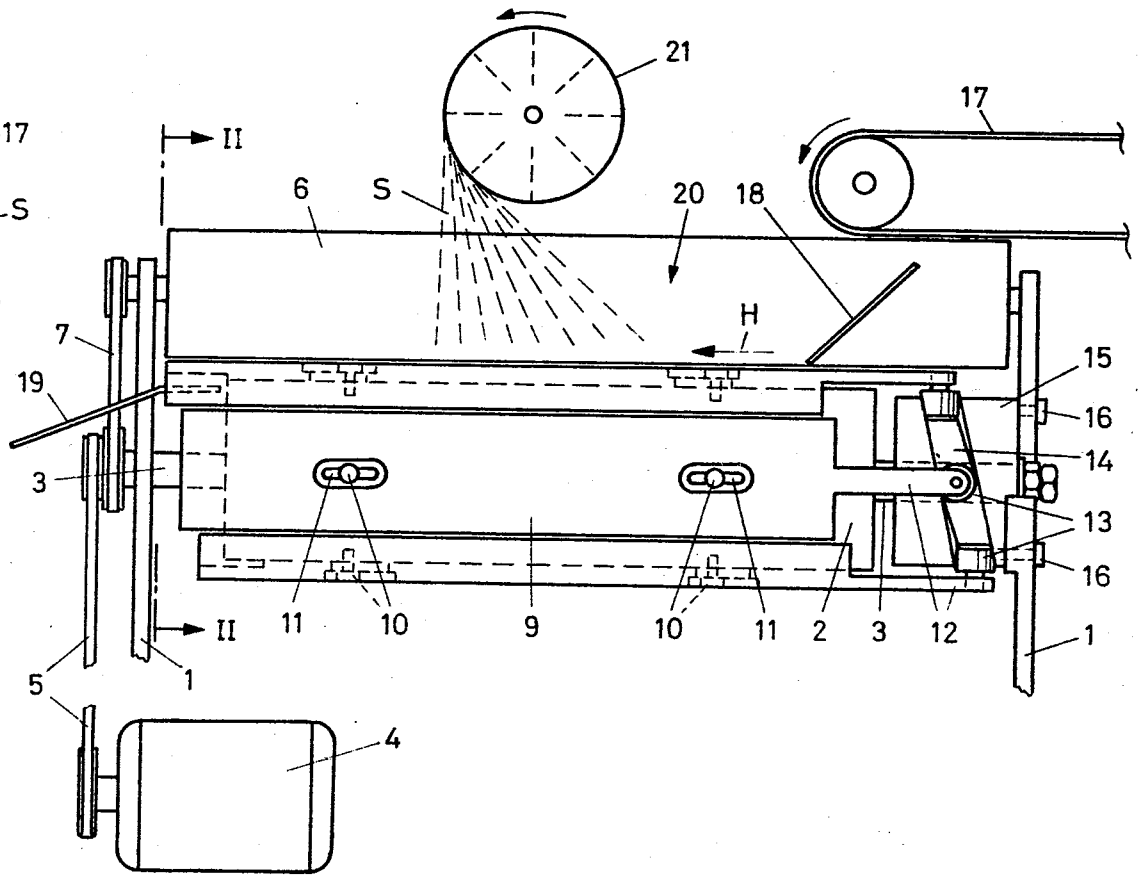
FIG. 1 is a side view of an apparatus according to a preferred embodiment of the invention.
Figure 2:
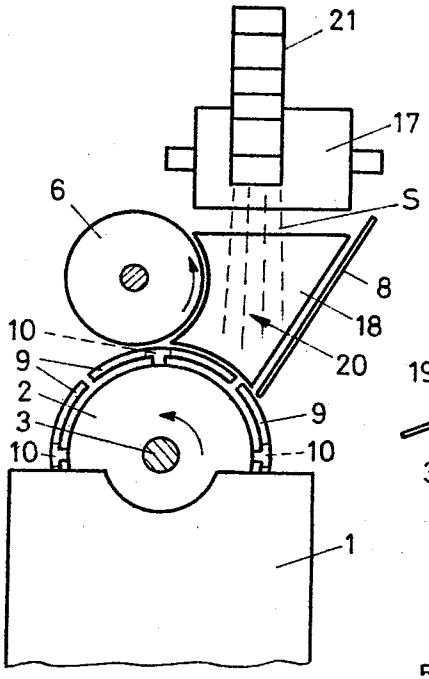
FIG. 2 is a section according to line II—II in FIG. 1.

In a frame structure 1 of the preferred objects treating apparatus shown in FIGS. 1 and 2, a horizontal roller 2 is rotatably mounted by means of a shaft 3. This shaft 3 is driven by an electric motor 4, having preferably a variable rate of rotation, via a V-belt 5. A second roller 6 is arranged above the roller 2 and is driven via V-belt 7 and shaft 3 in the same sense of rotation as, and at a somewhat higher speed than, the roller 1. Moreover, a wall 8 is mounted above the roller 2 at an angle to the vertical. Such wall forms together with the vicinal outer surface of the roller 6 and with the intermediate bottom region provided by the roller 2 with segments 9 a trough for the objects to be conveyed and turned. The distance of the wall 8 and of the roller 6 from the surface of the roller 2 with segments 9 may be made adjustable.

The roller 2 carries at its surface segments 9 forming a jacket or sheathing and corresponding in length approximately to the length of the roller 2. The segments 9 are mounted on the roller surface region by head bolts 10 which engage longitudinal slots 11 of the segments and permit a displacement of the segments on the surface of the roller 2 in longitudinal or axial direction.

Each segment 9 has a rod 12 at the outer end of which there is mounted a cam follower pin or preferably a roller 13. The roller 13 engates a slanted cam track 14 being closed in itself and being provided in a cam block 15, such as by milling.

The cam block 15 is releasably attached to the frame structure 1, such as by screws 16. Upon release of the screws 16, the cam block 15 is rotatable or angularly adjustable about the axis of rotation of the roller 2, and is again arrestable in another angular position.

Also part of the apparatus is an endless conveyor belt 17 which supplies the objects to be treated to the trough 20. The trough 20 is delimited by a tilted guide plate 18. At the other end of the trough 20 there is arranged a discharge guide plate 19 for the treated objects. By way of example, a fan blower or centrifugal action wheel 21 of jet action surface action equipment provides a jet cone S of an abrasive for treating the objects in the mold.

The operation of the apparatus is as follows:

During rotation of the roller 2, the segments in the region of the trough 20 form alternatively or successively the bottom of the trough 20. The cam block 15 with cam track 14 is, for instance, angularly adjusted so that the segments 9 in the region of the trough 20 always execute a travel in the direction of the arrow H in FIG. 1. In this manner, an advance or transport of the objects in the trough is achieved. The objects are at the same time moved or propelled against the outer surface of the roller 6, through the rotation of which they are turned over. The surface of the roller 6 may be roughened or provided with projections or edges for improving the turning of the objects. The treated objects exit the apparatus via the discharge guide plate 19.

The object advance movement of the segments 9 may be controlled at will and the duration of treatment of the objects may thus be adapted by adjusting the cam block 15 and, as necessary, by imparting a special configuration to the cam track.

The apparatus is only shown diagrammatically in the drawings. Self-evidently, means and methods other than the illustrated ones may be employed, for instance, for mounting the segments on the roller 2 and, by way of further example, releasably attaching the cam block 15 to the frame structure 1.

I claim:

1. Apparatus for continuously conveying and simultaneously turning objects of arbitrary shape and size, comprising in combination:

a roller;

segments extending longitudinally on the periphery of, and mounted for limited axial displacement on, said roller;

means including said roller with segments for providing a conveyor and turning trough for said objects, wherein said roller with segments forms at least a bottom portion of said trough;

means for rotating said roller with segments;

means coupled to said segments for periodically imparting to said segments a reciprocating axial displacement; and means for feeding objects to said trough.

2. Apparatus as claimed in claim 1, wherein:

said displacement imparting means include a relatively stationary cam block and associated cam follower means connected to said segments.

3. Apparatus as claimed in claim 1, wherein:

said trough providing means include a second roller for forming a lateral wall portion of said trough, and means for rotating said second roller in the same sense of rotation as said roller with segments.

4. Apparatus as claimed in claim 3, wherein:

said trough providing means include a lateral wall extending parallel to said second roller.

5. Apparatus as claimed in claim 3, including:

means for treating said objects during conveyance and turning in said trough.

6. Apparatus as claimed in claim 3, including:

means for surface treating said objects with a jet of abrasive material during conveyance and turning in said mold.

7. Apparatus as claimed in claim 1, wherein:

said apparatus includes frame structure; and said displacement imparting means include a cam block and associated cam follower means connected to said segments, and means for mounting said cam block on said frame structure for selective release and angular adjustment about an axis of rotation of said roller.

8. Apparatus as claimed in claim 1, including:

means for treating said objects during conveyance and turning in said trough.

9.Apparatus as claimed in claim 1, including:

means for surface treating said objects with a jet of abrasive material during conveyance and turning in said mold.

* * * * *